US007408520B2

(12) United States Patent
Durham et al.

(10) Patent No.: US 7,408,520 B2
(45) **Date of Patent: *Aug. 5, 2008**

(54) SINGLE POLARIZATION SLOT ANTENNA ARRAY WITH INTER-ELEMENT CAPACITIVE COUPLING PLATE AND ASSOCIATED METHODS

(75) Inventors: Timothy E. Durham, Melbourne, FL (US); Anthony M. Jones, Palm Bay, FL (US); Sean C. Ortiz, West Melbourne, FL (US); Chris Synder, Melbourne, FL (US); Griffin K. Gothard, Satellite Beach, FL (US)

(73) Assignee: Harris Corporation, Melbourne, FL (US)

( * ) Notice: Subject to any disclaimer, the term of this patent is extended or adjusted under 35 U.S.C. 154(b) by 360 days.

This patent is subject to a terminal disclaimer.

(21) Appl. No.: 11/303,345

(22) Filed: Dec. 16, 2005

(65) Prior Publication Data

US 2007/0139274 A1 Jun. 21, 2007

(51) Int. Cl.
*H01Q 13/10* (2006.01)

(52) U.S. Cl. ..... 343/770; 343/700 MS; 343/853

(58) Field of Classification Search ..... 343/700 MS, 343/853, 767, 770
See application file for complete search history.

(56) References Cited

U.S. PATENT DOCUMENTS

| | | | | |
|---|---|---|---|---|
| 3,568,204 | A | 3/1971 | Blaisdell | 343/725 |
| 3,594,810 | A | 7/1971 | Kaloi | 343/848 |
| 3,995,277 | A | 11/1976 | Olyphant, Jr. | 343/846 |
| 4,173,019 | A | 10/1979 | Williams | 343/700 |
| 4,287,603 | A | 9/1981 | Moser | 455/293 |
| 4,546,358 | A | 10/1985 | Edlin et al. | 343/703 |
| 4,734,660 | A | 3/1988 | Lofgren | 333/21 |
| 5,389,937 | A | 2/1995 | Kaloi | 343/700 |
| 5,477,233 | A | 12/1995 | Hemming et al. | 343/767 |
| 5,485,167 | A | 1/1996 | Wong et al. | 343/753 |
| 5,790,078 | A * | 8/1998 | Suzuki et al. | 343/700 MS |
| 6,307,510 | B1 * | 10/2001 | Taylor et al. | 343/700 MS |
| 6,384,787 | B1 * | 5/2002 | Kim et al. | 343/700 MS |
| 6,512,487 | B1 | 1/2003 | Taylor et al. | 343/795 |
| 7,221,322 | B1 * | 5/2007 | Durham et al. | 343/700 MS |
| 2005/0099353 | A1 | 5/2005 | Jones et al. | 343/795 |

FOREIGN PATENT DOCUMENTS

| | | |
|---|---|---|
| WO | 03/003510 | 1/2003 |

* cited by examiner

*Primary Examiner*—HoangAnh T Le
(74) *Attorney, Agent, or Firm*—Allen, Dyer, Doppelt, Milbrath & Gilchrist, P.A.

(57) ABSTRACT

The slot-mode antenna includes an array of slot antenna units carried by a substrate, and each slot antenna unit has a pair of patch antenna elements arranged in laterally spaced apart relation about at least one central feed position. Adjacent patch antenna elements of adjacent slot-mode antenna units include respective spaced apart edge portions defining gaps therebetween, and a capacitive coupling layer or plates overlap the respective spaced apart edge portions to provide increased capacitive coupling therebetween. The capacitive coupling layer may include continuous or periodic capacitive coupling plates along each gap defined by the respective spaced apart edge portions.

20 Claims, 9 Drawing Sheets

SINGLE POLARIZATION SLOT ANTENNA ARRAY WITH INTER-ELEMENT CAPACITIVE COUPLING PLATE AND ASSOCIATED METHODS

FIELD OF THE INVENTION

The present invention relates to the field of communications, and, more particularly, to low profile phased array antennas and related methods.

BACKGROUND OF THE INVENTION

Existing microwave antennas include a wide variety of configurations for various applications, such as satellite reception, remote broadcasting, or military communication. The desirable characteristics of low cost, light-weight, low profile and mass producibility are provided in general by printed circuit antennas. The simplest forms of printed circuit antennas are microstrip antennas wherein flat conductive elements are spaced from a single essentially continuous ground element by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, light weight, low profile, and low sidelobes.

The bandwidth and directivity capabilities of such antennas, however, can be limiting for certain applications. While the use of electromagnetically coupled microstrip patch pairs can increase bandwidth, obtaining this benefit presents significant design challenges, particularly where maintenance of a low profile and broad beam width is desirable. Also, the use of an array of microstrip patches can improve directivity by providing a predetermined scan angle. However, utilizing an array of microstrip patches presents a dilemma. The scan angle can be increased if the array elements are spaced closer together, but closer spacing can increase undesirable coupling between antenna elements thereby degrading performance.

Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwidth of a phased array antenna with a wide scan angle is conventionally achieved by dividing the frequency range into multiple bands.

One example of such an antenna is disclosed in U.S. Pat. No. 5,485,167 to Wong et al. This antenna includes several pairs of dipole pair arrays each tuned to a different frequency band and stacked relative to each other along the transmission/reception direction. The highest frequency array is in front of the next lowest frequency array and so forth.

This approach may result in a considerable increase in the size and weight of the antenna while creating a Radio Frequency (RF) interface problem. Another approach is to use gimbals to mechanically obtain the required scan angle. Yet, here again, this approach may increase the size and weight of the antenna and result in a slower response time.

Harris Current Sheet Array (CSA) technology represents the state of the art in broadband, low profile antenna technology. For example, U.S. Pat. No. 6,512,487 to Taylor et al. is directed to a phased array antenna with a wide frequency bandwidth and a wide scan angle by utilizing tightly packed dipole antenna elements with large mutual capacitive coupling. The antenna of Taylor et al. makes use of, and increases, mutual coupling between the closely spaced dipole antenna elements to prevent grating lobes and achieve the wide bandwidth.

A slot version of the CSA has many advantages over the dipole version including the ability to produce vertical polarization at horizon, metal aperture coincident with external ground plane, reduced scattering, and stable phase center at aperture. Conformal aircraft antennas frequently require a slot type pattern, but the dipole CSA does not address these applications. Analysis and measurements have shown that the dipole CSA cannot meet requirements for vertical polarized energy at the horizon. The Dipole CSA is also limited in wide angle scan performance due to dipole-like element pattern over a ground plane.

SUMMARY OF THE INVENTION

In view of the foregoing background, it is therefore an object of the present invention to provide a slot antenna that can produce vertical polarized energy near the horizon and can scan to near grazing angles.

This and other objects, features, and advantages in accordance with the present invention are provided by a slot-mode antenna comprising an array of slot-mode antenna units carried by a substrate, and each slot-mode antenna unit comprising a pair of patch antenna elements arranged in laterally spaced apart relation about at least one central feed position. Adjacent patch antenna elements of adjacent slot-mode antenna units comprise respective spaced apart edge portions defining gaps therebetween, and a capacitive coupling layer or plates is adjacent the gaps and overlap the respective spaced apart edge portions to provide increased capacitive coupling therebetween.

The capacitive coupling plates may comprise continuous or periodic capacitive coupling plates along each gap defined by the respective spaced apart edge portions. The substrate may be flexible and preferably includes a ground plane and a dielectric layer adjacent thereto, and the patch antenna elements may be arranged on the dielectric layer opposite the ground plane and define respective slots therebetween. The patch antenna elements may have a same shape, such as a generally rectangular shape. The capacitive coupling plates may be arranged within the dielectric layer below the patch antenna elements or arranged within a second dielectric layer above the patch antenna elements.

An antenna feed structure may be provided for each antenna unit and comprising a pair of coaxial feed lines, each coaxial feed line comprising an inner conductor and a tubular outer conductor in surrounding relation thereto. The outer conductors are connected to the ground plane, and the inner conductors extend outwardly from ends of respective outer conductors, through the dielectric layer and are connected to respective patch antenna elements adjacent the central feed position.

A method aspect of the invention is directed to making a slot-mode antenna comprising forming an array of slot-mode antenna units carried by a substrate, each slot-mode antenna unit comprising a pair of patch antenna elements arranged in laterally spaced apart relation about a central feed position. Adjacent patch antenna elements of adjacent slot-mode antenna units have respective spaced apart edge portions defining gaps therebetween. The method includes providing capacitive coupling plates adjacent the gaps and overlapping the respective spaced apart edge portions to provide increased capacitive coupling therebetween.

The substrate may be flexible and comprise a ground plane and a dielectric layer adjacent thereto, and forming comprises arranging the patch antenna elements on the dielectric layer opposite the ground plane to define respective slots therebetween. Providing may include arranging the capacitive coupling plates within the dielectric layer below the patch antenna elements or arranging the capacitive coupling plates within a second dielectric layer above the patch antenna elements.

The method may further comprise providing an antenna feed structure for each antenna unit and comprising a pair of coaxial feed lines, each coaxial feed line comprising an inner conductor and a tubular outer conductor in surrounding relation thereto. The outer conductors are connected to the ground plane, and the inner conductors extend outwardly from ends of respective outer conductors, through the dielectric layer and are connected to respective patch antenna elements adjacent the central feed position.

The slot antenna of the present invention is capable of being matched at a lower frequency for a given unit cell size and ground plane spacing than the conventional dipole CSA. Analysis shows that the slot antenna produces the element pattern of a slot antenna, and can produce vertically polarized radiated energy near the horizon as well as scan to near grazing angles. Performance characteristics are significantly more independent of unit cell size than has been observed for dipoles, and more elements are possible within a limited size.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
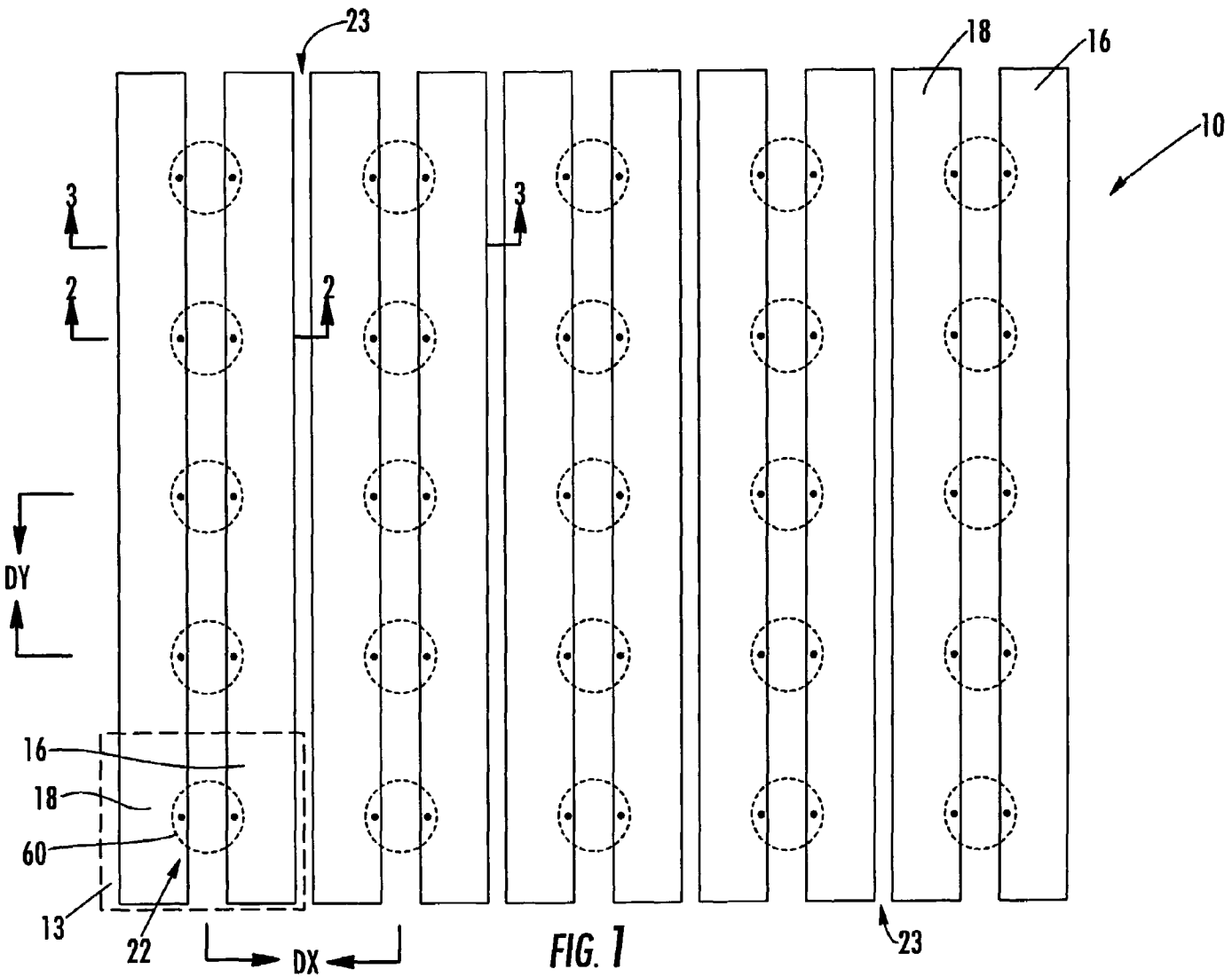
FIG. 1 is a schematic plan view of a single-polarization, slot antenna array in accordance with the present invention.

Referring to FIGS. 1-4, a single polarization, slot antenna array 10 according to the invention will now be described. The antenna 10 includes a substrate 12 having a ground plane 26 and a dielectric layer 24 adjacent thereto, and at least one antenna unit 13 carried by the substrate. Preferably, a plurality of antenna units 13 are arranged in an array. As shown in FIG. 1, the antenna 10, for example, includes a five-by-five array of twenty-five antenna units 13. Each antenna unit 13 includes two adjacent antenna patches or elements 16, 18, arranged in spaced apart relation from one another about a central feed position 22 on the dielectric layer 24 opposite the ground plane 26. Preferably, the pairs of antenna elements 16/18, are fed with 0/180° phase across their respective gaps to excite a slot mode. The phasing of the element excitations also provides a single polarization slot mode, as would be appreciated by the skilled artisan.

Figure 2:
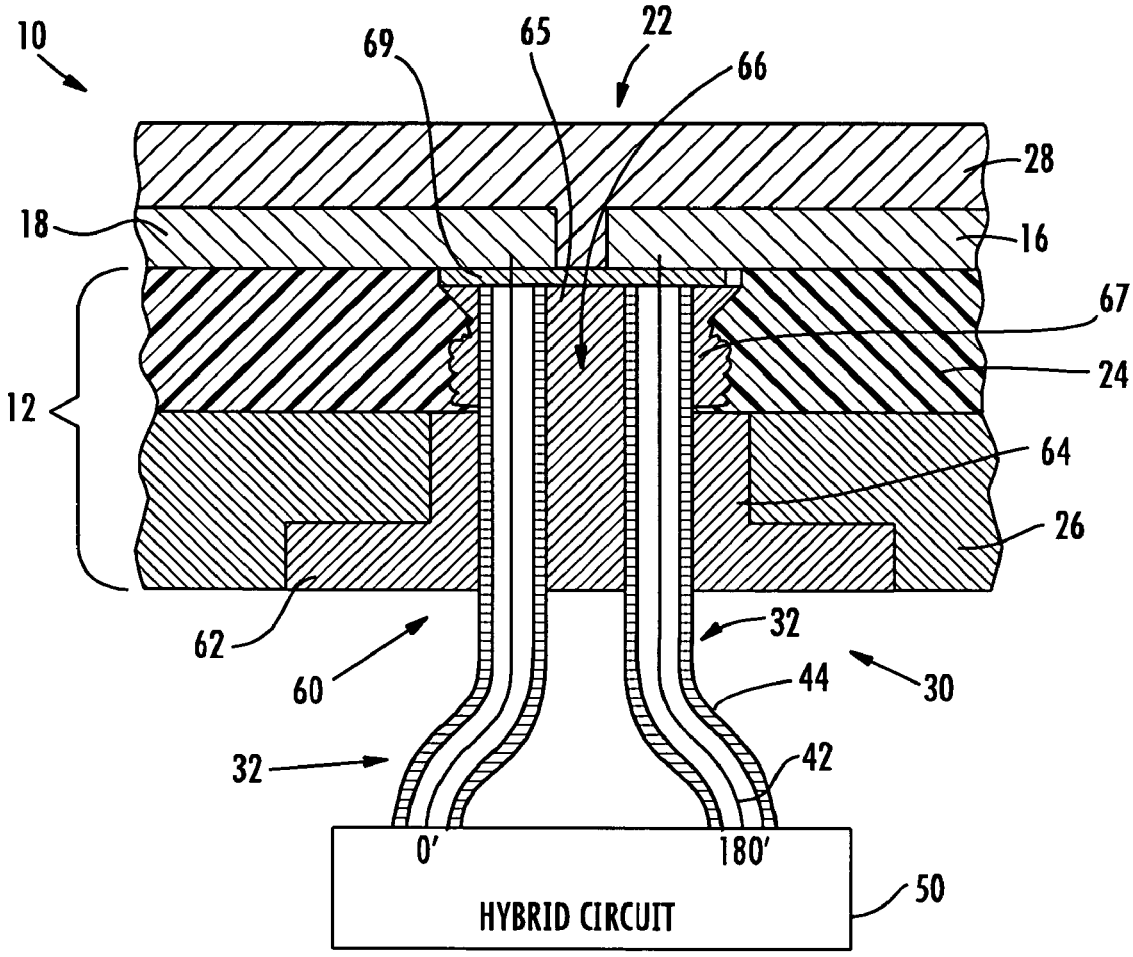
FIG. 2 is a cross-sectional view of the antenna including the antenna feed structure taken along the line 2-2 in FIG. 1.
Figure 3:
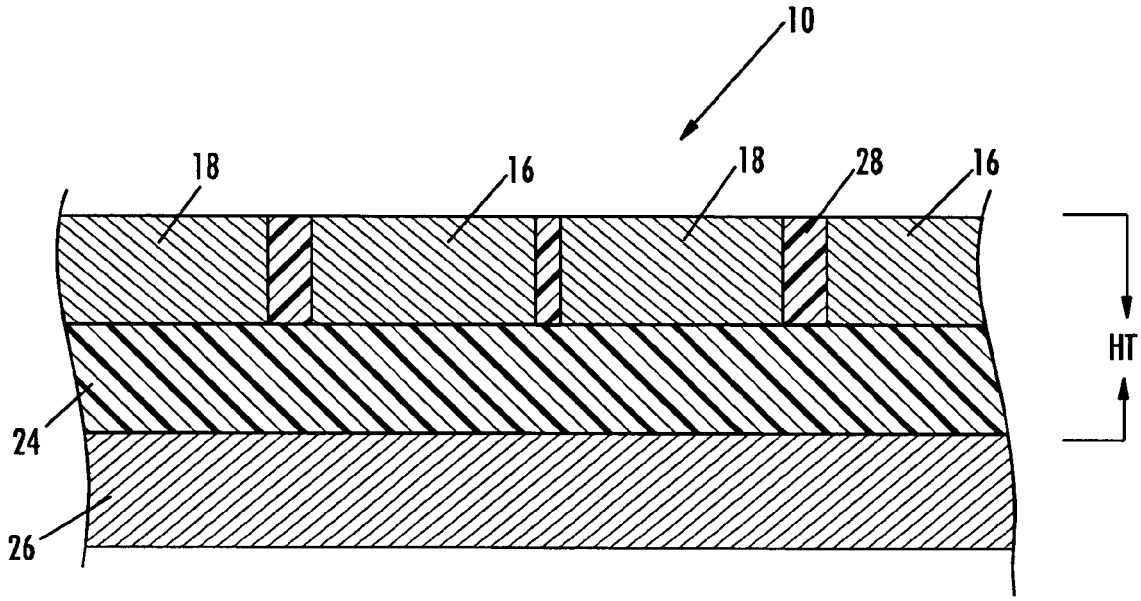
FIG. 3 is a cross-sectional view of the ground plane, dielectric layer, antenna units and upper dielectric layer of the antenna taken along the line 3-3 in FIG. 1.

Each antenna unit may also include an antenna feed structure 30 including two coaxial feed lines 32. Each coaxial feed line 32 has an inner conductor 42 and a tubular outer conductor 44 in surrounding relation thereto, for example (FIG. 2). The antenna feed structure 30 includes a feed line organizer body 60 having passageways therein for receiving respective coaxial feed lines 32. The feed line organizer 60 is preferably integrally formed as a monolithic unit, as will be appreciated by those of skill in the art.

More specifically, the feed line organizer body 60 may include a base 62 connected to the ground plane 26. A bottom enclosed guide portion 64 may be carried by the base 62, a top enclosed guide portion 65 is adjacent the antenna elements 16, 18 and an intermediate open guide portion 66 extends between the bottom enclosed guide portion and the top enclosed guide portion. The outer conductor 44 of each coaxial feed line 32 may be connected to the feed line organizer body 60 at the intermediate open guide portion 66 via solder 67, as illustratively shown in FIG. 2.

The feed line organizer body 60 is preferably made from a conductive material, such as brass, for example, which allows for relatively easy production and machining thereof. As a result, the antenna feed structure 30 may be produced in large quantities to provide consistent and reliable ground plane 26 connection. Of course, other suitable materials may also be used for the feed line organizer body 60, as will be appreciated by those of skill in the art.

Additionally, as illustratively shown in FIG. 2, the coaxial feed lines 32 are parallel and adjacent to one another. Furthermore, the antenna feed structure 30 may advantageously include a tuning plate 69 carried by the top enclosed guide portion 65. The tuning plate 69 may be used to compensate for feed inductance, as will be appreciated by those of skill in the art.

More specifically, the feed line organizer body 60 allows the antenna feed structure 30 to essentially be "plugged in" to the substrate 12 for relatively easy connection to the antenna unit 13. The antenna feed structure 30 including the feed line organizer body 60 also allows for relatively easy removal and/or replacement without damage to the antenna 10. Moreover, common mode currents, which may result from improper grounding of the coaxial feed lines 32 may be substantially reduced using the antenna feed structure 30 including the feed line organizer body 60. That is, the intermediate open guide portion 66 thereof allows for consistent and reliable grounding of the coaxial feed lines 32.

The ground plane 26 may extend laterally outwardly beyond a periphery of the antenna units 13, and the coaxial feed lines 32 may diverge outwardly from contact with one another upstream from the central feed position 22, as can be seen in FIG. 2. The antenna 10 may also include at least one hybrid circuit 50 carried by the substrate 12 and connected to the antenna feed structure 30. The hybrid circuit 50 controls, receives and generates the signals to respective antenna elements 16, 18 of the antenna units 13, as would be appreciated by those skilled in the art.

The dielectric layer 24 preferably has a thickness in a range of about ½ an operating wavelength near the top of the operating frequency band of the antenna 10, and at least one upper or impedance matching dielectric layer 28 may be provided to cover the antenna units 13. This impedance matching dielectric layer 28 may also extend laterally outwardly beyond a periphery of the antenna units 13. The substrate 12 is flexible and can be conformally mounted to a rigid surface, such as the nose-cone of an aircraft or spacecraft, for example.

Figure 4A:
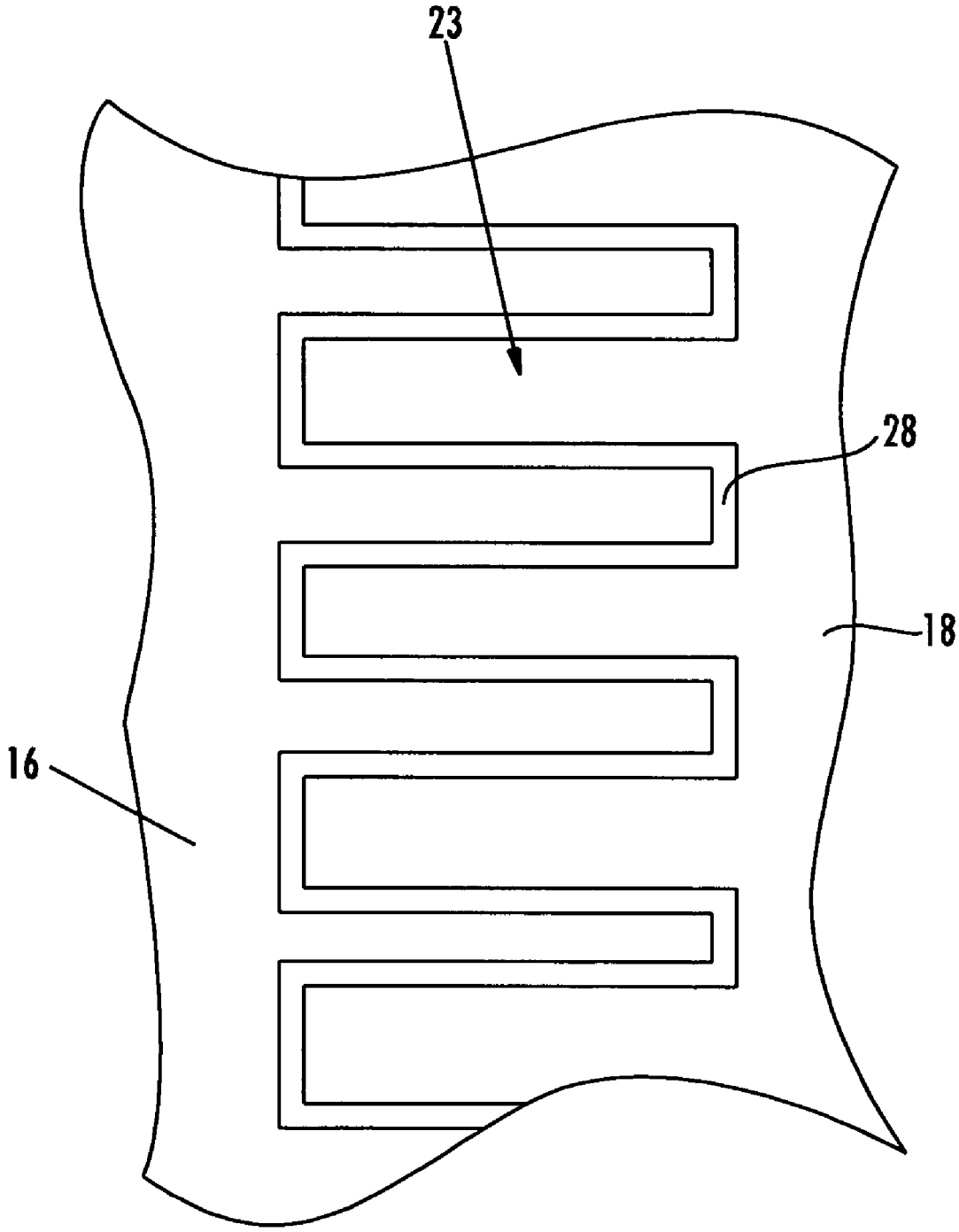
FIGS. 4A and 4B are enlarged views of respective embodiments of the interdigitated spaced apart edge portions of adjacent antenna elements of adjacent antenna units in the antenna array of FIG. 1.
Figure 4B:
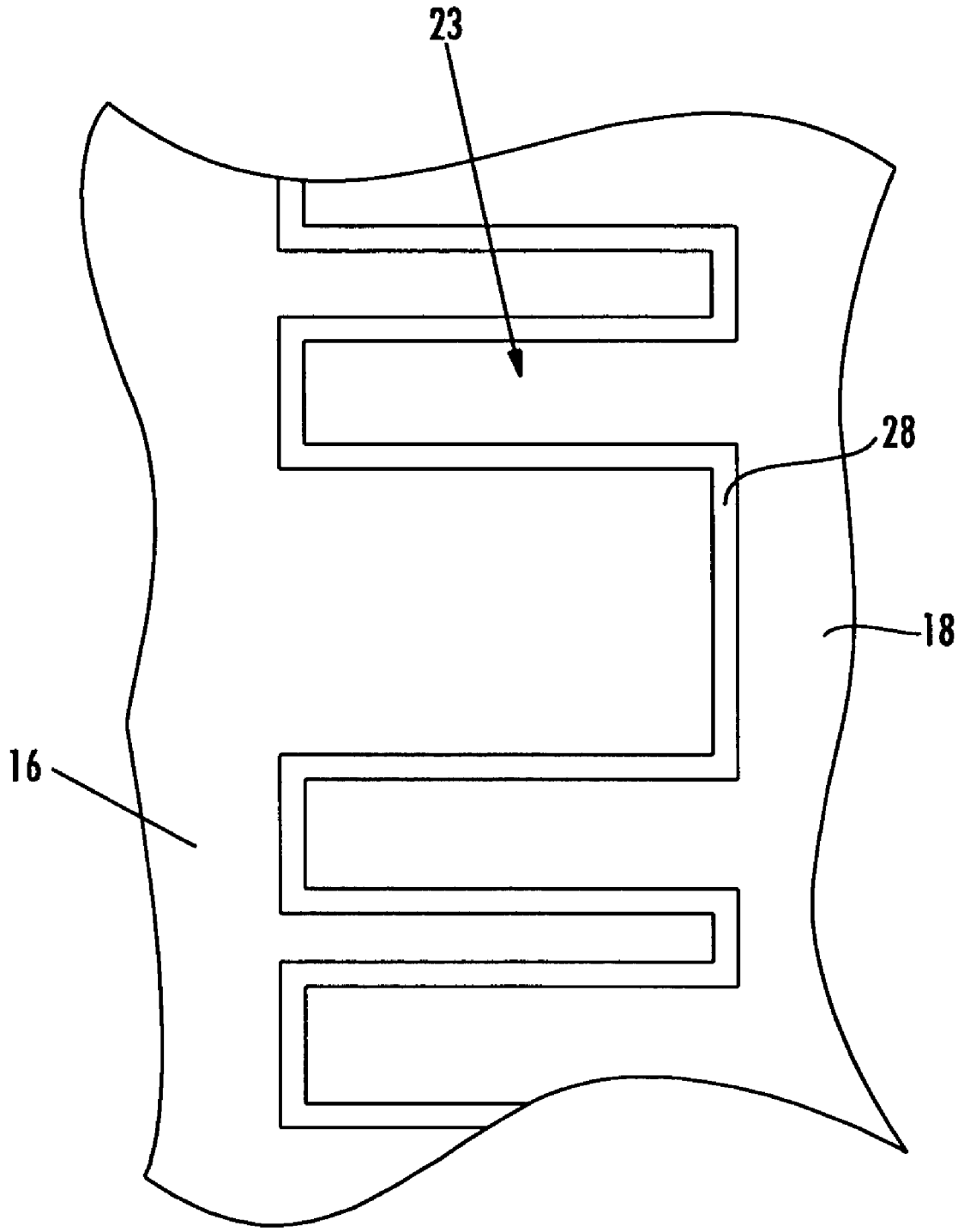

Referring more specifically to FIGS. 1, 4A and 4B, adjacent patch antenna elements 16, 18 of adjacent slot-mode antenna units 13 include respective spaced apart edge portions 23 having predetermined shapes and relative positioning to provide increased capacitive coupling therebetween. The respective spaced apart edge portions 23 may be interdigitated, as shown in the enlarged views of FIGS. 4A and 4B, to provide the increased capacitive coupling therebetween. As such, the spaced apart edge portions 23 may be continuously interdigitated along the edge portions (FIG. 4A) or periodically interdigitated along the edge portions (FIG. 4B).

Figure 7:
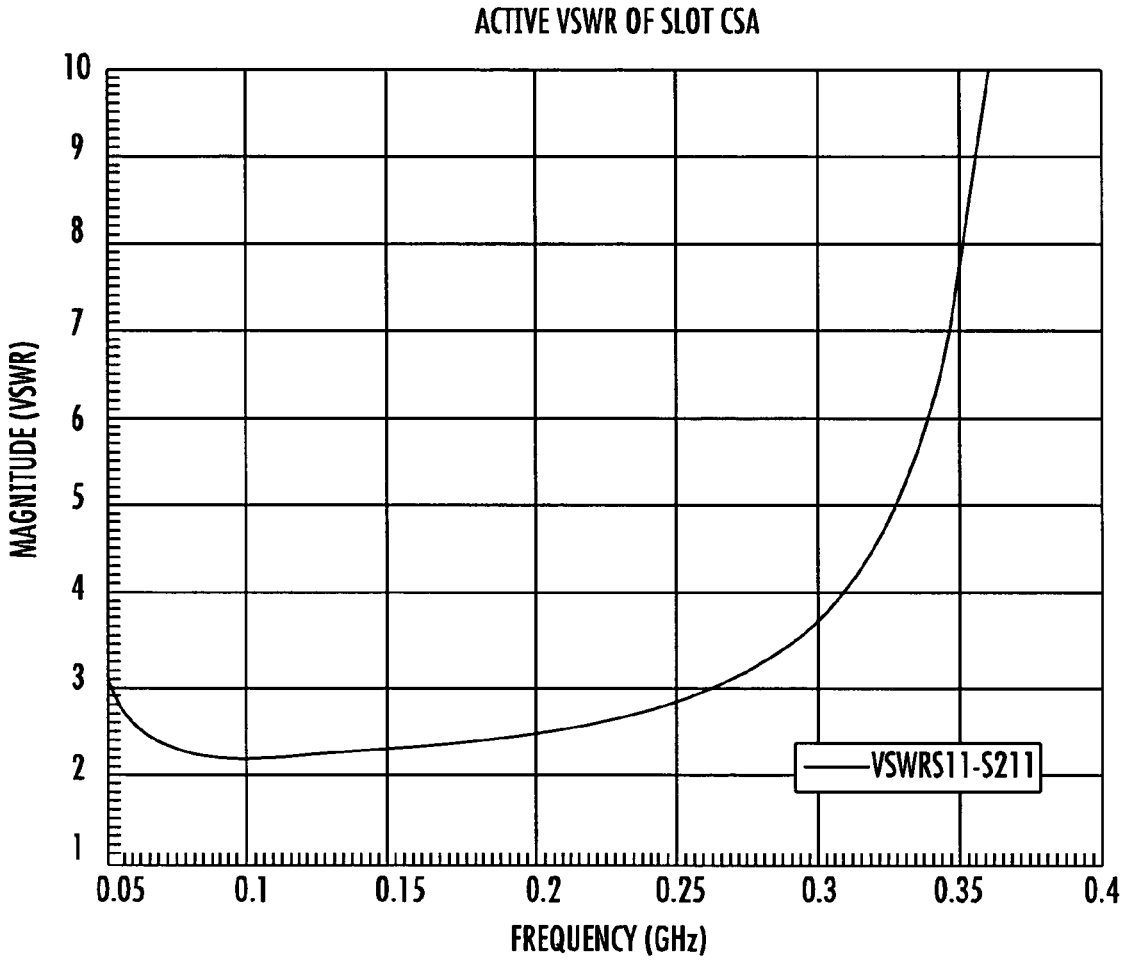
FIG. 7 is a graph illustrating the relative VSWR to frequency of the single-polarization, slot antenna array of the present invention.

The relative Voltage Standing Wave Ratio (VSWR) to frequency of the single-polarization, slot antenna array 10 of the present invention is illustrated in the graph of FIG. 7.

Thus, an antenna array 10 with a wide frequency bandwidth and a wide scan angle is obtained by utilizing the antenna elements 16, 18 of each slot-mode antenna unit 13 having mutual capacitive coupling with the antenna elements 16, 18 of an adjacent slot-mode antenna unit 13. Conventional approaches have sought to reduce mutual coupling between elements, but the present invention makes use of, and increases, mutual coupling between the closely spaced antenna elements to achieve the wide bandwidth.

A related method aspect of the invention is for making a single-polarization, slot antenna 10 including forming an array of slot-mode, antenna units 13 carried by a substrate 12, each single-polarization, slot antenna unit comprising four patch antenna elements 16, 18 arranged in laterally spaced apart relation about a central feed position 22. The method includes shaping and positioning respective spaced apart edge portions 23 of adjacent patch antenna elements of adjacent single-polarization, slot antenna units 13 to provide increased capacitive coupling therebetween.

Shaping and positioning may include continuously or periodically interdigitating the respective spaced apart edge portions 23, as shown in the enlarged views of FIGS. 4A and 4B. Again, the substrate 12 may be flexible and comprise a ground plane 26 and a dielectric layer 24 adjacent thereto, and forming the array comprises arranging the pair of patch antenna elements 16, 18 on the dielectric layer opposite the ground plane to define respective slots therebetween.

The method may further include forming an antenna feed structure 30 for each antenna unit and comprising two coaxial feed lines 32, each coaxial feed line comprising an inner conductor 42 and a tubular outer conductor 44 in surrounding relation thereto. The outer conductors 44 are connected to the ground plane 26, and the inner conductors 42 extend outwardly from ends of respective outer conductors, through the dielectric layer 24 and are connected to respective patch antenna elements at the central feed position 22, for example, as shown in FIG. 2.

Figure 5:
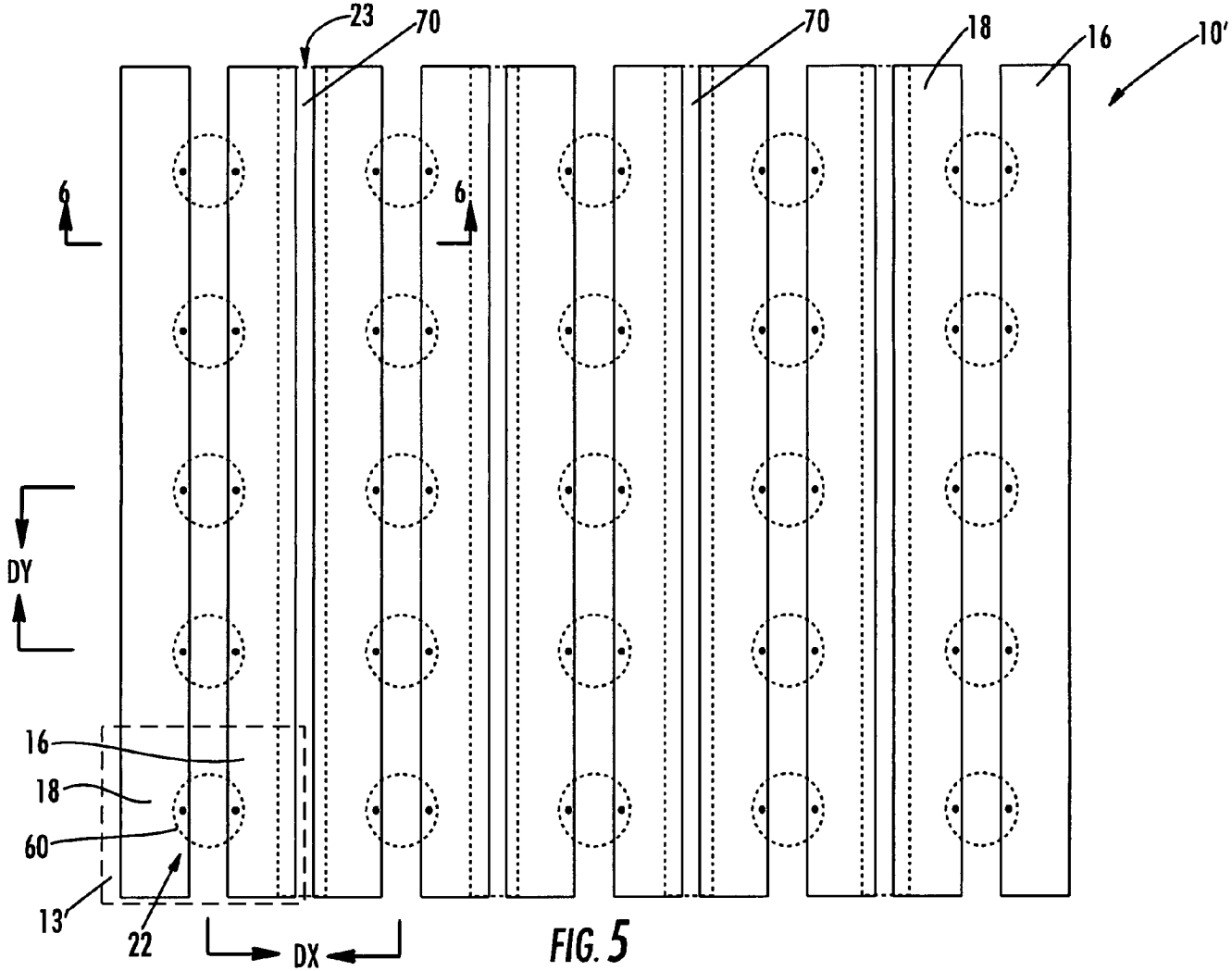
FIG. 5 is a schematic plan view of another embodiment of the single-polarization, slot antenna array in accordance with the present invention.
Figure 6A:
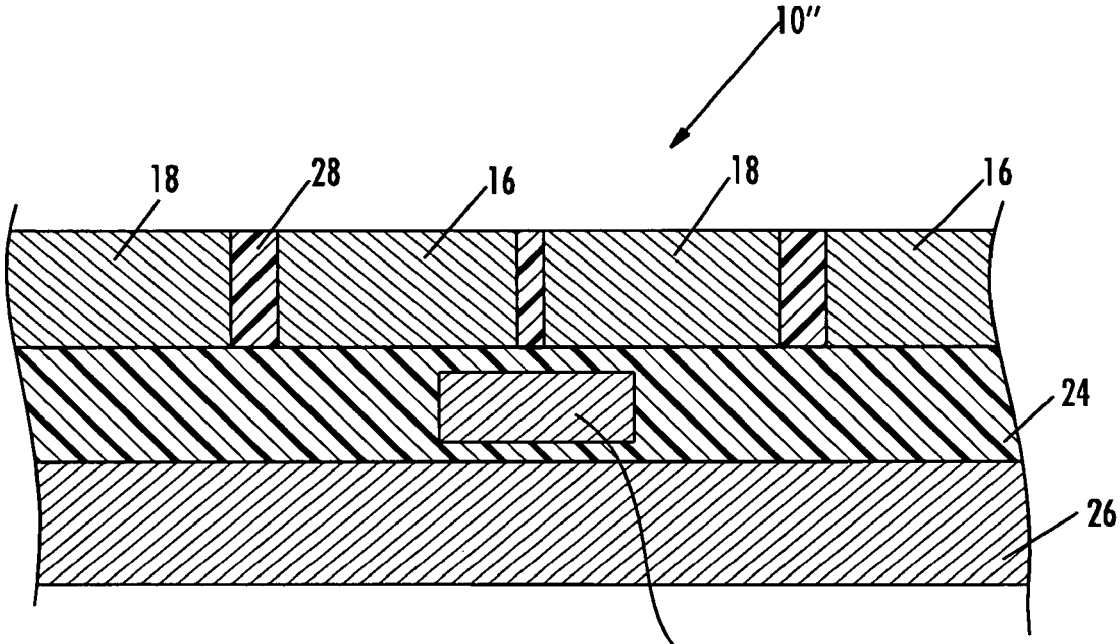
FIG. 6A is a cross-sectional view of the ground plane, dielectric layer, antenna units and capacitive coupling plates of the antenna taken along the line 6-6 in FIG. 5.
Figure 6B:
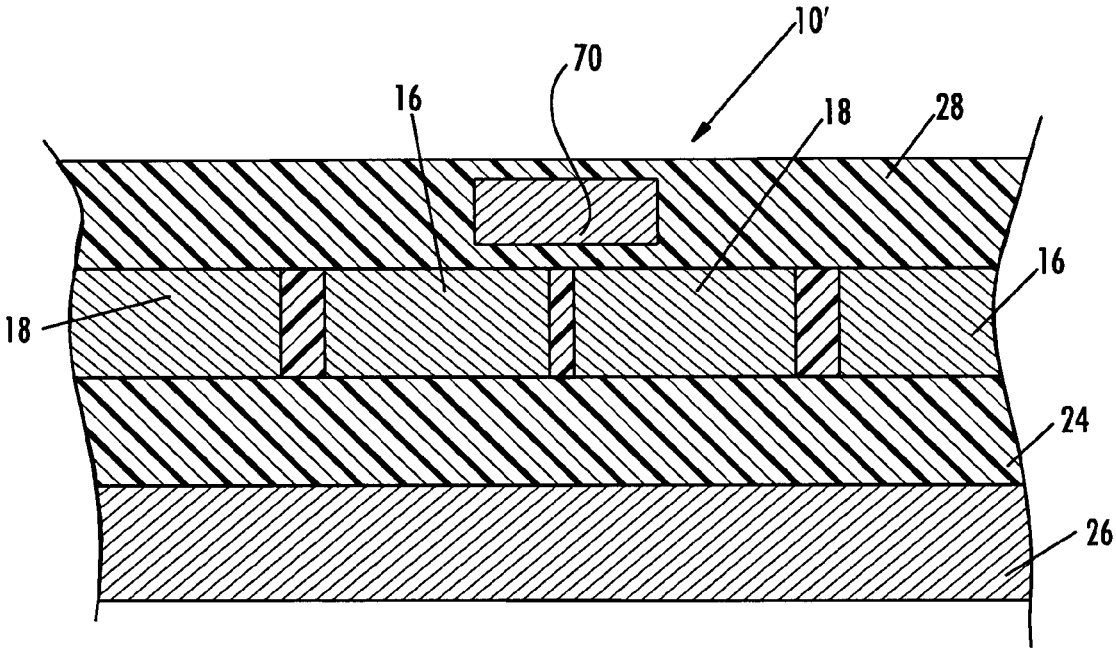
FIG. 6B is a cross-sectional view of another embodiment with the capacitive coupling plates in an upper dielectric layer of the antenna of FIG. 5.

Referring now to FIGS. 5, 6A and 6B, another embodiment of a single polarization slot mode antenna 10' will now be described. Adjacent patch antenna elements 16, 18 of adjacent slot-mode antenna units 13' have respective spaced apart edge portions 23 defining gaps therebetween. A capacitive coupling layer or plates 70 are adjacent the gaps and overlap the respective spaced apart edge portions 23 to provide the increased capacitive coupling therebetween. The capacitive coupling plates 70 may be arranged within the dielectric layer 24 (FIG. 6A) below the patch antenna elements or within the second dielectric layer 28 above the patch antenna elements plane (FIG. 6B).

Thus, an antenna array 10' with a wide frequency bandwidth and a wide scan angle is obtained by utilizing the antenna elements 16, 18 of each slot-mode antenna unit 13' having mutual capacitive coupling with the antenna elements 16, 18 of an adjacent slot-mode antenna unit 13'.

A method aspect of this embodiment of the invention is directed to making a slot-mode antenna and includes providing a respective capacitive coupling plate 70 adjacent each gap and overlapping the respective spaced apart edge portions 23 to provide the increased capacitive coupling therebetween. Again, the capacitive coupling plates 70 may be arranged within the dielectric layer 24 below the patch antenna elements or within the second dielectric layer 28 above the patch antenna elements.

The antenna 10, 10' may have a seven-to-one bandwidth for 2:1 VSWR, and may achieve a scan angle of +/−75 degrees. The antenna 10, 10' may have a greater than ten-to-one bandwidth for 3:1 VSWR. Thus, a lightweight patch array antenna 10, 10' according to the invention with a wide frequency bandwidth and a wide scan angle is provided. Also, the antenna 10, 10' is flexible and can be conformally mountable to a surface, such as an aircraft.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A slot-mode antenna comprising:

a substrate; and an array of slot-mode antenna units carried by said substrate, and each slot-mode antenna unit comprising a pair of patch antenna elements arranged in laterally spaced apart relation about at least one central feed position;

adjacent patch antenna elements of adjacent slot-mode antenna units comprising respective spaced apart edge portions defining gaps therebetween; and a capacitive coupling layer overlapping the respective spaced apart edge portions to provide increased capacitive coupling therebetween.

2. The antenna according to claim 1 wherein the capacitive coupling layer comprises continuous capacitive coupling plates along each gap defined by the respective spaced apart edge portions.

3. The antenna according to claim 1 wherein the capacitive coupling layer comprises periodic capacitive coupling plates along each gap defined by the respective spaced apart edge portions.

4. The antenna according to claim 1 wherein said substrate comprises a ground plane and a dielectric layer adjacent thereto; and wherein the patch antenna elements are arranged on said dielectric layer opposite said ground plane and define respective slots therebetween.

5. The antenna according to claim 4 wherein the capacitive coupling plates are arranged within the dielectric layer.

6. The antenna according to claim 4 further comprising a second dielectric layer covering the patch antenna elements; and wherein the capacitive coupling plates are arranged within the second dielectric layer.

7. The antenna according to claim 4 further comprising an antenna feed structure for each antenna unit and comprising a pair of coaxial feed lines, each coaxial feed line comprising an inner conductor and a tubular outer conductor in surrounding relation thereto, said outer conductors being connected to said ground plane, said inner conductors extending outwardly from ends of respective outer conductors, through said dielectric layer and being connected to respective patch antenna elements at the central feed position.

8. The antenna according to claim 1 wherein all of said patch antenna elements have a same shape.

9. The antenna according to claim 8 wherein each patch antenna element has a generally rectangular shape.

10. The antenna according to claim 1 wherein said substrate is flexible.

11. A slot-mode antenna comprising:

a substrate comprising a ground plane and a dielectric layer adjacent thereto; and an array of slot-mode, antenna units carried by said substrate;

each slot-mode antenna unit comprising a pair of patch antenna elements arranged in laterally spaced apart relation about a central feed position and on said dielectric layer opposite said ground plane;

adjacent patch antenna elements of adjacent slot-mode antenna units having respective spaced apart edge portions defining gaps therebetween; and capacitive coupling plates adjacent the gaps and overlapping the respective spaced apart edge portions to provide increased capacitive coupling therebetween.

12. The antenna according to claim 11 wherein the capacitive coupling plates are arranged within the dielectric layer.

13. The antenna according to claim 11 further comprising a second dielectric layer covering the patch antenna elements; and wherein the capacitive coupling plates are arranged within the second dielectric layer.

14. The antenna according to claim 11 further comprising an antenna feed structure for each antenna unit and comprising a pair of coaxial feed lines, each coaxial feed line comprising an inner conductor and a tubular outer conductor in surrounding relation thereto, said outer conductors being connected to said ground plane, said inner conductors extending outwardly from ends of respective outer conductors, through said dielectric layer and being connected to respective antenna elements at the central feed position.

15. The antenna according to claim 11 wherein said substrate is flexible.

16. A method of making a slot-mode antenna comprising:

forming an array of slot-mode antenna units carried by a substrate, each slot-mode antenna unit comprising a pair of patch antenna elements arranged in laterally spaced apart relation about a central feed position, adjacent patch antenna elements of adjacent slot-mode antenna units having respective spaced apart edge portions defining gaps therebetween; and providing capacitive coupling plates adjacent the gaps and overlapping the respective spaced apart edge portions to provide increased capacitive coupling therebetween.

17. The method according to claim 16 wherein said substrate comprises a ground plane and a dielectric layer adjacent thereto; and wherein forming comprises arranging the patch antenna elements on said dielectric layer opposite said ground plane to define respective slots therebetween.

18. The method according to claim 17 wherein providing comprises arranging the capacitive coupling plates within the dielectric layer.

19. The method according to claim 17 wherein providing comprises:

covering the patch antenna elements with a second dielectric layer; and arranging the capacitive coupling plates within the second dielectric layer.

20. The method according to claim 16 further comprising providing an antenna feed structure for each antenna unit and comprising a pair of coaxial feed lines, each coaxial feed line comprising an inner conductor and a tubular outer conductor in surrounding relation thereto, said outer conductors being connected to said ground plane, said inner conductors extending outwardly from ends of respective outer conductors, through said dielectric layer and being connected to respective patch antenna elements at the central feed position.

* * * * *